United States Patent [19]

Fleming et al.

[11] Patent Number: 4,671,089

[45] Date of Patent: Jun. 9, 1987

[54] DOOR LATCH AND DEADBOLT ASSEMBLY

[75] Inventors: Paul D. Fleming, Glendale; David L. O'Day, Canoge Park, both of Calif.

[73] Assignee: W&F Manufacturing, Inc.

[21] Appl. No.: 825,053

[22] Filed: Jan. 31, 1986

[51] Int. Cl.[4] ..... E05B 15/02

[52] U.S. Cl. ..... 70/452; 70/422; 70/461

[58] Field of Search ..... 70/452, 422, 461, 451, 70/381

[56] References Cited

U.S. PATENT DOCUMENTS

| | | | |
|---|---|---|---|
| 1,546,626 | 7/1925 | Crouch | 70/422 |
| 3,899,907 | 8/1975 | Prahl | 70/452 |
| 4,338,806 | 7/1982 | Cox | 70/422 |
| 4,573,334 | 3/1986 | Crepinsek | 70/452 |

*Primary Examiner*—Robert L. Wolfe

*Attorney, Agent, or Firm*—Kelly, Bauersfeld & Lowry

[57] ABSTRACT

A combination door latch and deadbolt assembly includes an improved latch mechanism and deadbolt mechanism designed for use with doors having a variety of standard size backset and cross bore dimensions. The latch and deadbolt mechanisms are carried by escutcheons havings breakaway tabs at varying diametric positions to fit securely within door cross bores of different standard sizes. The latch mechanism further includes an improved mounting arrangement for left- or right-hand mounting and positive centering of lever-type door handles, together with a simplified cam-actuated latch retractor. The deadbolt mechanism includes an improved bolt linkage which provides a desired bolt throw when a relatively small door backset and/or cross bore size is used. The deadbolt mechanism further includes an improved thumb turn rotatable through ninety degrees between orientations representative of deadbolt position.

22 Claims, 19 Drawing Figures

20
18
28
10
18
18
10
24
14
10
20'
10
32
24
95
20
28
87
32
22
22'
48
26
84
30
88
18
75
16
78
21'
21
23
44
12
46
20'
27
30
14
34

DOOR LATCH AND DEADBOLT ASSEMBLY

BACKGROUND OF THE INVENTION

This invention relates generally to improvements in door latch and door deadbolt mechanisms. More specifically, this invention relates to a combination door latch and deadbolt assembly which incorporates a variety of improvements facilitating use thereof with a range of standard door backset and/or cross bore dimensions.

Door lock assemblies including latch and/or deadbolt mechanisms are generally well known in the art. Such mechanisms are typically installed within an open cross bore formed through a door and include a spring-loaded latch or deadbolt extending laterally from the cross bore for sliding reception into and/or retraction from an appropriate lock recess formed in an adjacent door jamb. Door handles or knobs are normally provided on the inner and outer sides of the door for use in manual retraction of a spring-loaded latch. Conversely, deadbolt mechanisms are normally key-operated from the outer side of the door to advance or retract the deadbolt from the lock recess, with a thumb turn or additional key operation being provided on the inner side of the door.

In the past, door latch and deadbolt mechanisms have been provided in different sizes which have evolved as relative industry standards. More particularly, the diametric size of the cross bore formed in the door normally assumes one of several relatively standard dimensions. Moreover, the distance or backset of the center of the cross bore from the side margin of the door may also assume one of several relatively standard distances. Unfortunately, previous door latch and/or deadbolt mechanisms or combinations thereof have generally been manufactured to fit one particular set of cross bore and backset dimensions, thereby requiring production and/or stocking of several different product sizes. In addition, when relatively small cross bore dimensions are used, some deadbolt mechanisms have not provided sufficient bolt throw distance for optimum security.

Additional disadvantages encountered with many prior art latch mechanisms relate to inadequate mounting arrangements for stylized lever-type door handles. Such lever-type door handles extend laterally from the associated latch mechanism and are typically mounted on both sides of the door to extend away from the adjacent door jamb. However, previous designs have not satisfactorily accommodated easy and interchangeable left- or right-hand mounting of such handles, nor have previous designs provided adequate support means for preventing droop of a relatively heavy lever-type handle from a selected, for example, horizontal attitude when not in use.

Moreover, while many deadbolt mechanisms are known to include a thumb turn on the inner side of the door for easy manual rotation to advance or retract the deadbolt, previous deadbolt mechanisms have generally required thumb turn rotation through an angle significantly greater than ninety degrees to achieve the desired deadbolt displacement. However, this inherently places the thumb turn at a nonhorizontal position when the deadbolt is advanced and/or retracted, resulting in an unattractive skewed appearance which does not visually reflect the operational position of the deadbolt. It is thus necessary to manually check the deadbolt position.

There exists, therefore, a significant need for improved door latch and deadbolt mechanisms overcoming the disadvantages discussed hereinabove. The present invention fulfills these needs and provides further related advantages.

SUMMARY OF THE INVENTION

In accordance with the invention, an improved door latch mechanism and an improved deadbolt mechanism are provided preferably in the form of a combination assembly and adapted for relatively easy mounting into a door having any of a range of standard cross bore and/or backset dimensions. The latch mechanism further includes an improved door handle mounting arrangement, whereas the deadbolt mechanism further includes an actuating thumb turn designed for rotation between two positions at which the thumb turn visually represents the retracted or advanced position of the deadbolt.

In accordance with one preferred form of the invention, the improved latch and deadbolt mechanisms are carried by inner and outer escutcheons which support the mechanisms within a respective pair of cross bores formed in the door with a selected and preferably standard diametric size dimension. The escutcheons include inboard-facing sets of breakaway tabs formed at different diametric positions, wherein selected tabs can be broken off at the time of installation to leave a set of tabs dimensioned to fit securely into the associated cross bore. For small-sized cross bores, all of the tabs can be broken off the leave the latch and deadbolt mechanisms which fit securely into the small standard-sized cross bores.

The preferred latch mechanism includes a cam sleeve rotatable by one or both door handles on the opposite sides of the door. This cam sleeve includes a cam lobe engageable irrespective of rotational direction with a simplified latch retractor including twisted tab cam followers to retract a door latch which is spring-loaded toward a normal advanced position.

The improved door handle mounting arrangement is specially adapted for left- or right-handed mounting and stable support of lever-type door handles. This mounting arrangment comprises a socket for keyed attachment to each door handle. The socket is secured to the associated escutcheon by a retainer ring or the like which also seats a spring-loaded retention finger in a predetermined position engaged with the socket. Accordingly, rotation of the door handle and socket is resisted by the spring-loaded retention finger for spring-actuated return to a leveled or other preselected orientation when not in use. The socket is keyed in turn with the cam sleeve to retract the latch upon door handle rotation.

The preferred deadbolt mechanism includes a bolt linkage mounted within the associated cross bore and having a drive link rotatable with a key unit and a thumb turn accessible respectively from the inner and outer sides of the door. The drive link is coupled via a lost motion pivot to an output link coupled in turn to the deadbolt. The lost motion pivot is guided along a ramped, nonhorizontal track within the cross bore to accommodate a substantial bolt throw notwithstanding use of a relatively small cross bore. Moreover, the drive link is rotatable through about ninety degrees between advanced and retracted deadbolt positions which correspond respectively with horizontal and vertical thumb turn positions. The thumb turn thus visually represents deadbolt position.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figures 1, 2:
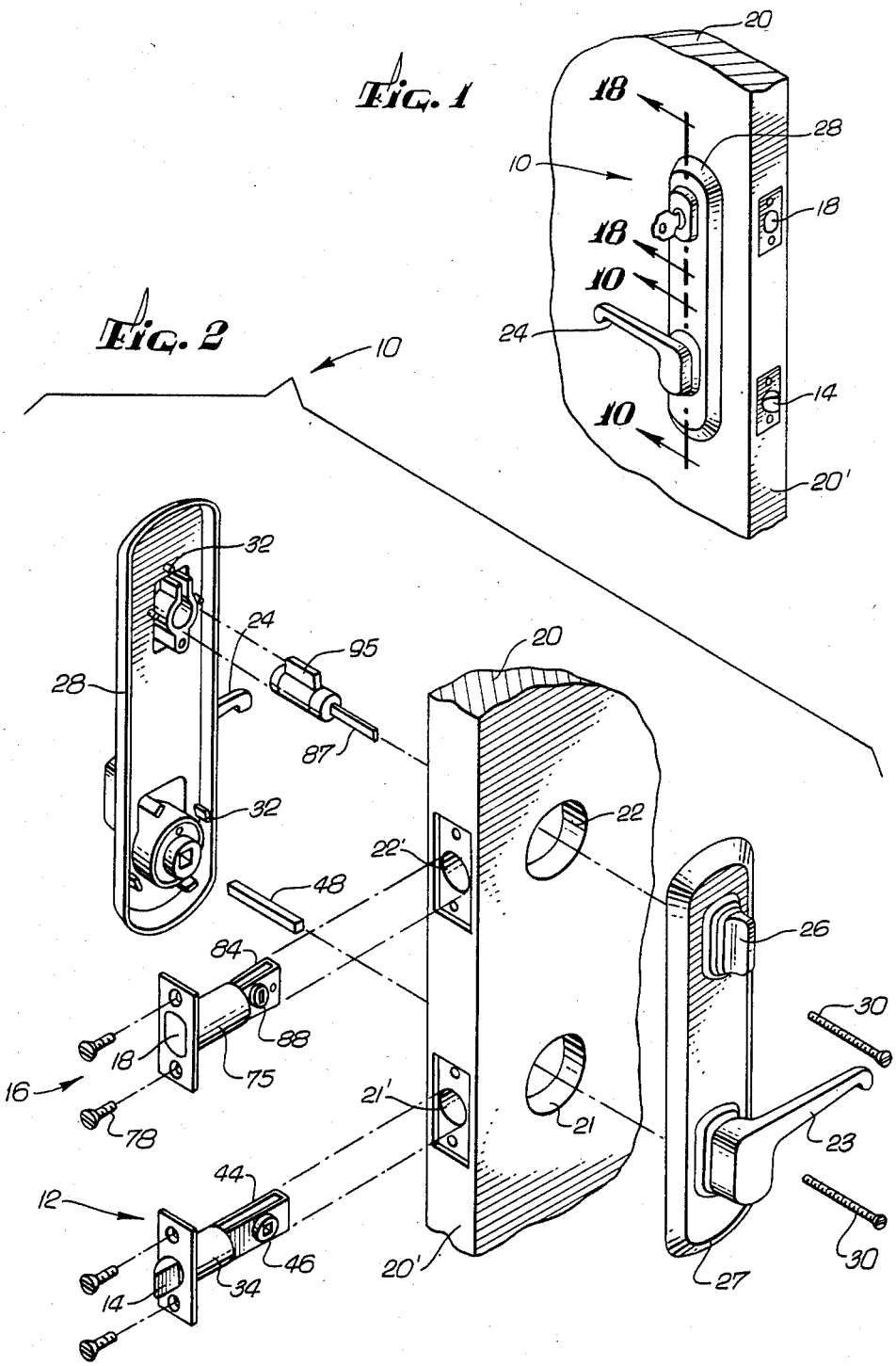
FIG. 1 is a fragmented perspective view illustrating a combination latch and deadbolt assembly embodying the novel features of the invention.
FIG. 2 is a fragmented exploded perspective view illustrating the latch and deadbolt assembly.

As shown in the exemplary drawings, a combination latch and deadbolt assembly is referred to generally by the reference numeral 10. The assembly 10 includes an improved latch mechanism 12 having a spring-loaded latch 14 together with an improved deadbolt mechanism 16 having a sliding deadbolt 18. The latch mechanism 12 and the deadbolt mechanism 16 are adapted for rapid installation onto a door 20.

The combination latch end deadbolt assembly 10 of the present invention is designed to mount rapidly and securely with respect to associated cross bores 21 and 22 formed in the door 20, wherein the cross bores can be formed to have any of several industry-standard diameters. The latch and deadbolt mechanisms 12 and 16 are designed to operate smoothly and with clearance respectively within said cross bores to provide the requisite latch operation and bolt throw for securing the door in the closed and locked position. The latch mechanism 12 includes an improved door handle mounting arrangement which facilitates left- of right-hand mounting of lever-type handles 23 and 24. In addition, the deadbolt mechanism 16 includes a thumb turn 26 for operating the deadbolt from the inner side of the door, wherein the thumb turn 26 visually represents the locked of unlocked condition of the deadbolt.

As shown best in FIG. 1 and 2, the improved latch and deadbolt assembly 10 includes vertically elongated escutcheons 27 and 28 for mounting respectively on the inner and outer sides of the door. These escutcheons 27 and 28 are formed typically from metal material and have a size and shape to overlap the cross bores 21 and 22. The cross bores 21 and 22 are formed in the door to extend completely through between the inner and outer sides and to have selected diameters centered in vertical alignment with each other and located from the marginal edge 20' of the door by a selected backset spacing dimension. The diametric sizes of the cross bores and the backset spacings are chosen to correspond with any of several industry-standard sizes. Mounting screws 30 are passed through the inner escutcheon 27 and the cross bores for fastening into the outer escutcheon 28 to clamp the escutcheons tightly onto the door 20.

The latch and deadbolt mechanisms 12 and 16 are supported within their respective cross bores by the escutcheons. Importantly, in accordance with one aspect of the invention, the escutcheons include sets of breakaway tabs 32 (FIGS. 2, 10–12 and 19) oriented in groups at one or more diametric positions to fit snugly into cross bores of different sizes. For example, one diammetrically opposed pair of the tabs 32 can be positioned to fit snugly into a cross bore diameter of about $2\frac{1}{8}''$, whereas another pair of the tabs can be positioned to fit snugly into a cross bore diameter of about $1\frac{7}{8}''$. Additional tab sets can be provided to fit into a still smaller cross bore, such as about $1\frac{5}{8}''$, or, as depicted in the drawings, the latch and deadbolt mechanisms may include components (to be described) to fit snugly into the smaller cross bore. Accordingly, upon installation, a single assembly 10 can be adapted by the installer to fit the associated cross bores by merely breaking off some or all of the tabs 32. Additional assembly designs to fit different cross bores are thus not required.

The latch mechanism 12 is provided in a simplified, easily assembled construction for rapid mounting into the lower cross bore 21 prior to final installation of the escutcheons 27 and 28. More particularly, as shown in one preferred form in FIGS. 2 and 3, the latch mechanism 12 comprises a generally cylindrical latch case 34 sized to fit smoothly into a latch bore 21' extending laterally from the cross bore 21 toward the door marginal edge 20'. As is known in the art, the latch case is joined to an outer face shield 35 which is secured to the marginal edge of the door along with a face plate 36 by a pair of screws 37 or the like.

The latch 14 has a conventional shape protruding from the door marginal edge 20' under the influence of a spring 38 reacting between the latch and a rear wall 34' of the latch case. In addition, the latch 14 is secured by a pair of roll pins 39 or the like to the forward end of a latch retractor 40. The rear end of the latch retractor extends out of the latch case 34 and terminates in a rearwardly open, generally U-shaped yoke with the legs thereof twisted through ninety degrees and defining a pair of twisted tab cam followers 42 in parallel relation with each other. A cam housing 44 shields the inner and outer sides of the retractor 40 and is defined by a pair housing halves with feet locked into the latch case 34 and interconnected to each other by rivets 45 or the like.

A cam sleeve 46 also forms part of the latch mechanism and includes a sqaure bore 46' receiving a rotatable actuator shaft 48 of mating square section and extending through aligned openings 44' in the cam housing. This shaft 48 is rotatably operated by the door handles 23 and 24, as will be described in more detail. Upon such rotation, however, the cam sleeve is correspondingly rotated to move an external cam lobe 49 thereon into engagement with one of the twisted tab followers 42 to retract the latch toward an open position within the latch case 34, as viewed in FIGS. 5–8. The particular tab follower 42 engaged by the cam lobe 49 depends, of course, upon the direction of handle rotation, whereby both handles rotate together and either can thus be rotated in either direction to retract the latch 14. Importantly, however, the twisted tab followers 42 provide a simplified and inexpensively manufactured means for responding to cam lobe motion.

Figures 3, 4:
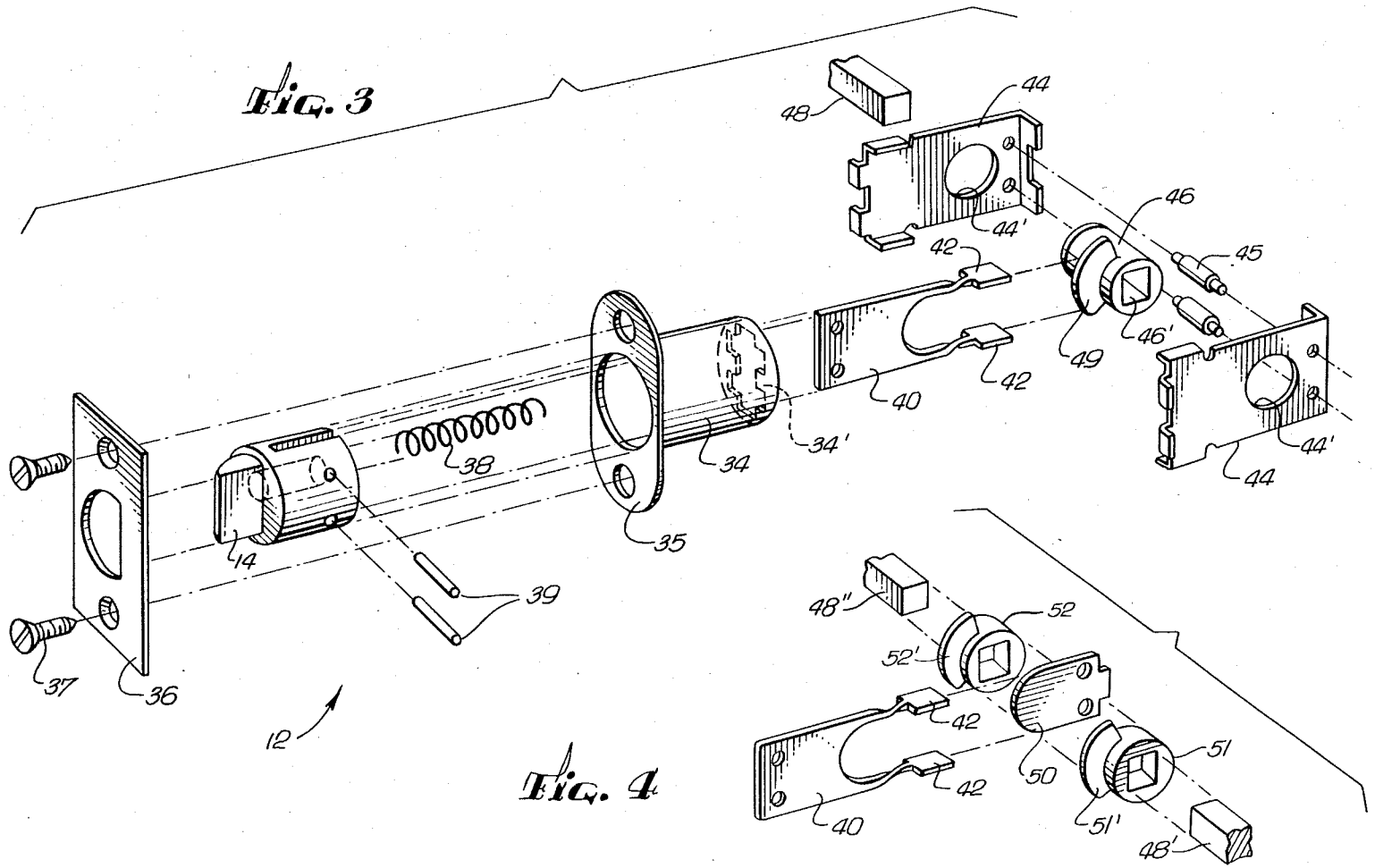
FIG. 3 is an exploded perspective view illustrating a latch mechanism forming a portion of the invention.
FIG. 4 is an exploded perspective view similar to a portion of FIG. 3 and depicting an alternative form of the latch mechanism.
Figure 5:
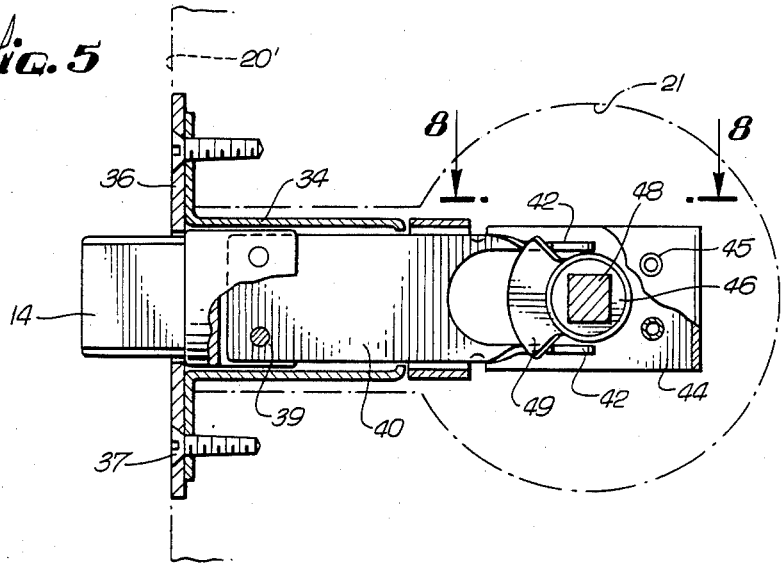
FIG. 5 is a fragmented vertical sectional view illustrating the latch mechanism installed within a door.
Figure 6:
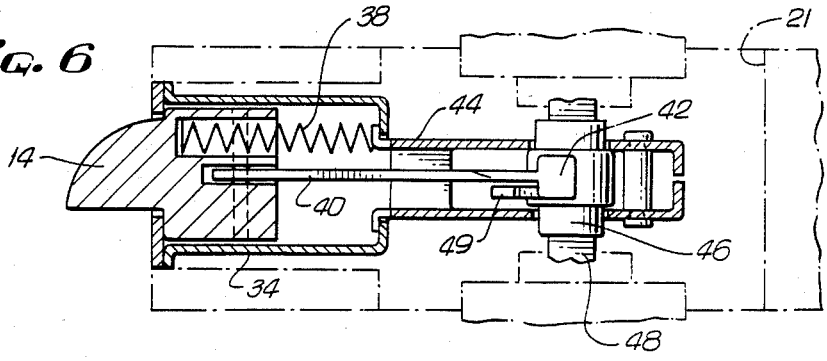
FIG. 6 is a fragmented horizontal sectional view illustrating the latch mechanism installed within a door.
Figure 7:
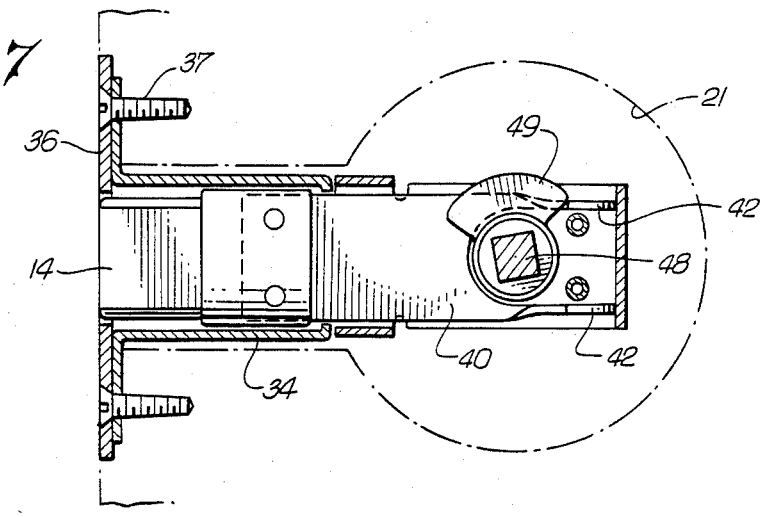
FIG. 7 is a fragmented vertical sectional view similar to FIG. 5 and showing the latch mechanism in a retracted position.
Figure 8:
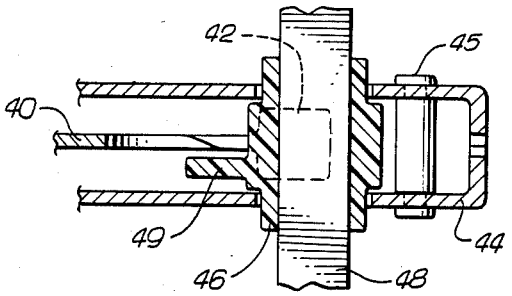
FIG. 8 is an enlarged fragmented vertical sectional view taken generally of the line 8—8 of FIG. 5.
Figure 9:
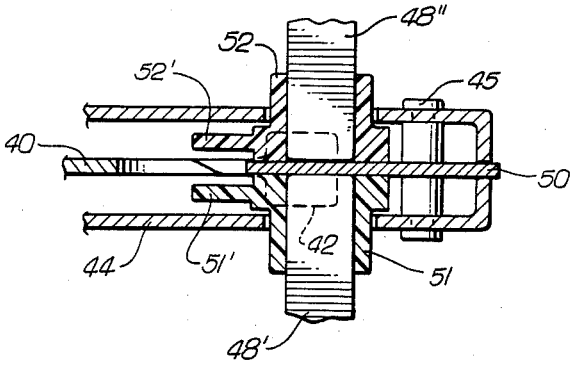
FIG. 9 is an enlarged fragmented vertical sectional view similar to FIG. 5 but depicting the alternative latch mechanism of FIG. 4.

In one alternate form of the invention, the latch mechanism can be modified as viewed in FIGS. 4 and 9 to isolate the door handles from rotation together when one of the handles is operated to retract the latch 14. More specifically, in this version, a center plate 50 is anchored by the rivets 45 between the halves of the cam housing 44 and within the rear yoke portion of the latch retractor 40. The actuator shaft is divided into a first portion 48' and a second portion 48'' respectively operated by the two door handles 23 and 24 but rotatably isolated from one another by the center plate 50. The cam sleeve is also divided into separate portions 51 and 52 on opposite sides of the center plate 50, with each sleeve portion carrying an external cam lobe 51' and 52', respectively. Accordingly, rotation of either handle 23 or 24 in either direction effectively engages the associated cam lobe 51' or 52' with one the twisted tab followers 42 to retract the latch 14.

Figure 10:
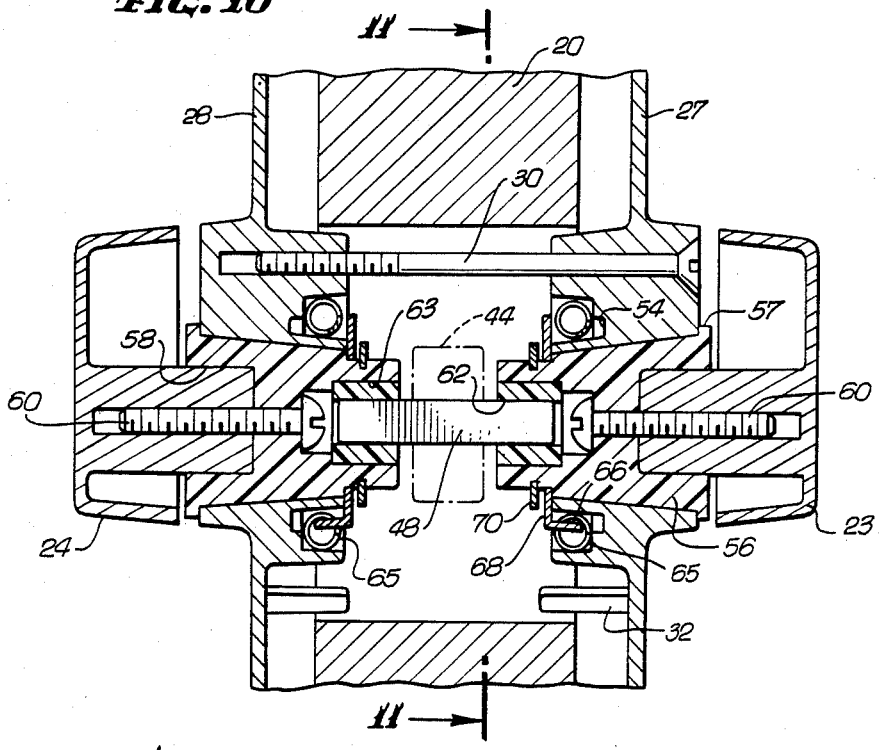
FIG. 10 is an enlarged fragmented vertical sectional view taken generally on the line 10—10 of FIG. 1.
Figure 11:
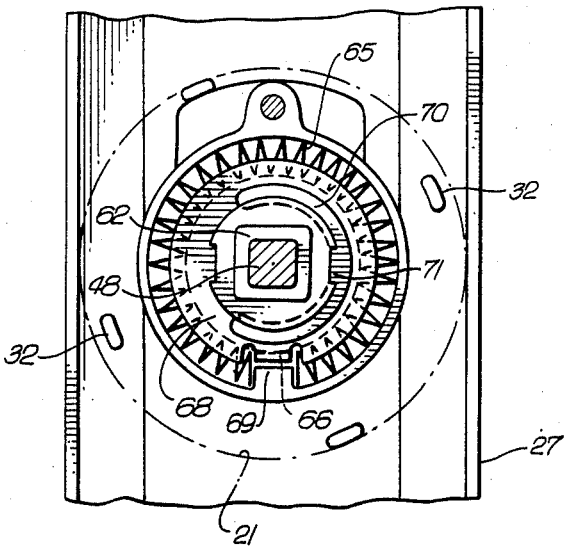
FIG. 11 is a fragmented vertical sectional view taken generally on the line 11—11 of FIG. 10.
Figure 12:
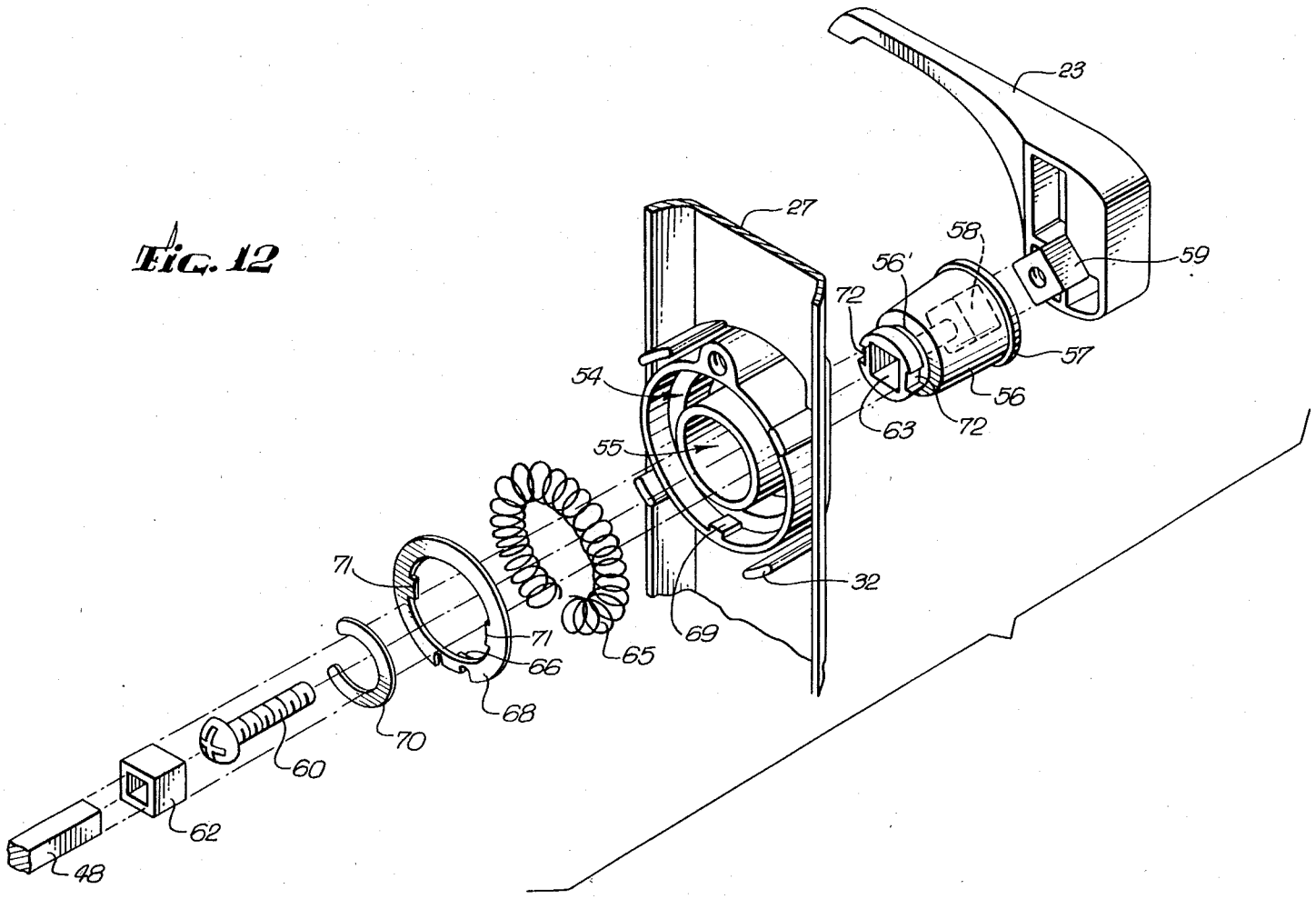
FIG. 12 is an exploded perspective view illustrating a preferred door handle mounting and support arrangement.
Figure 13:
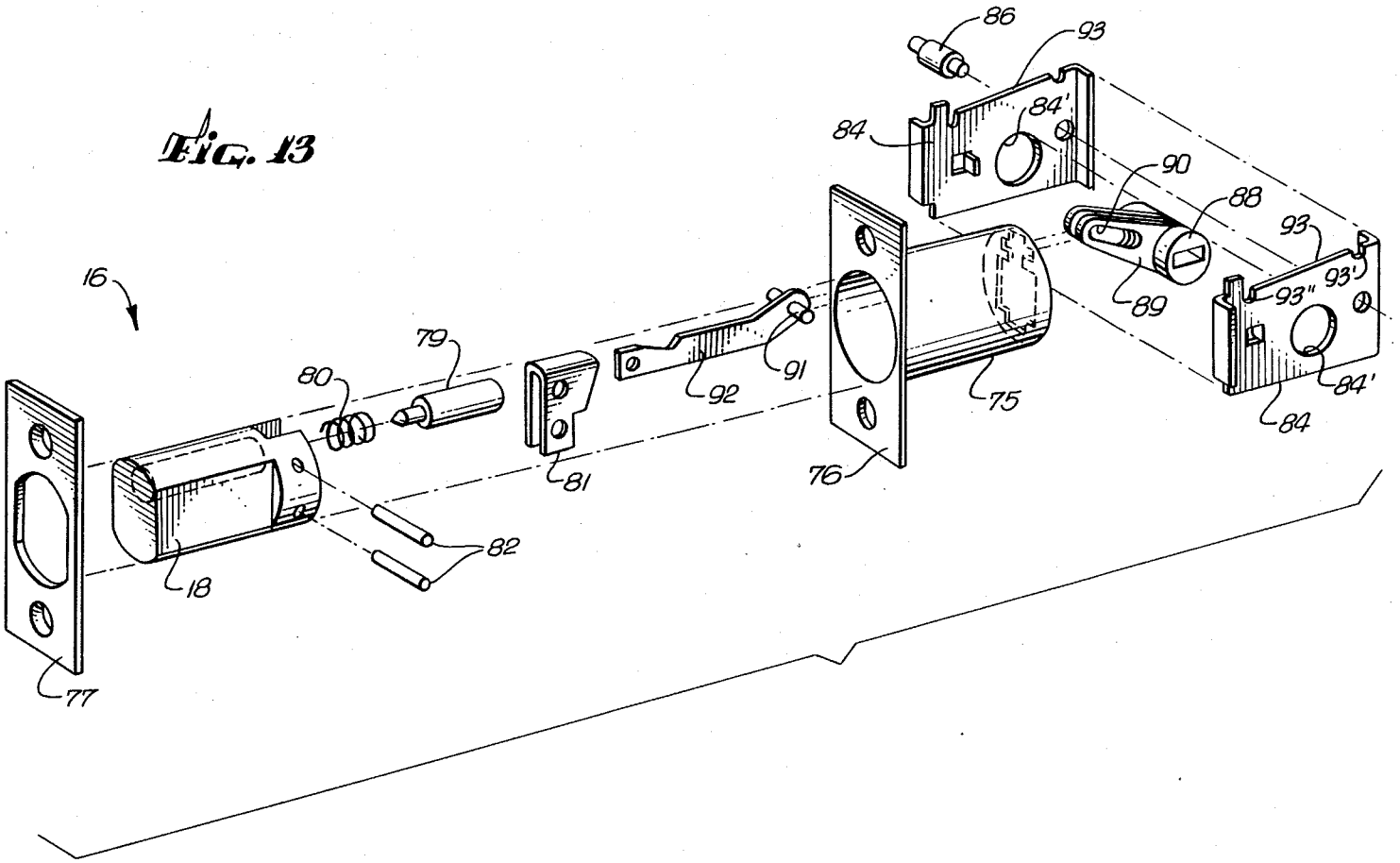
FIG. 13 is an exploded perspective view illustrating a deadbolt mechanism forming a portion of the invention.
Figure 14:
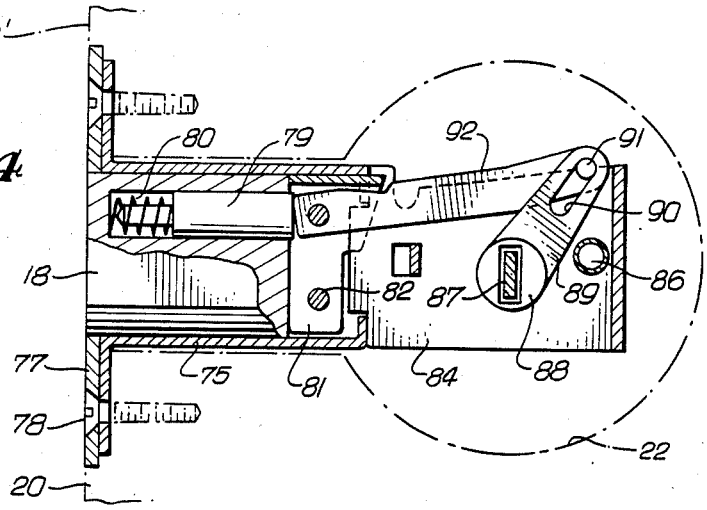
FIG. 14 is a fragmented vertical sectional view illustrating the deadbolt mechanism installed within a door.
Figure 15:
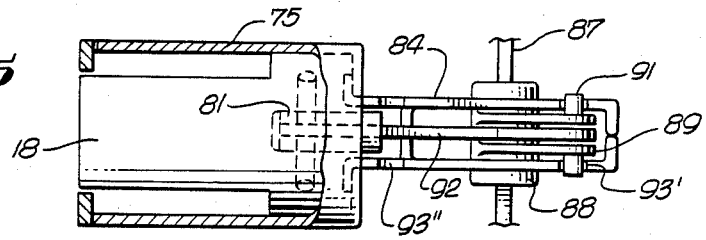
FIG. 15 is a fragmented horizontal sectional view illustrating the deadbolt mechanism installed within a door.
Figure 16:
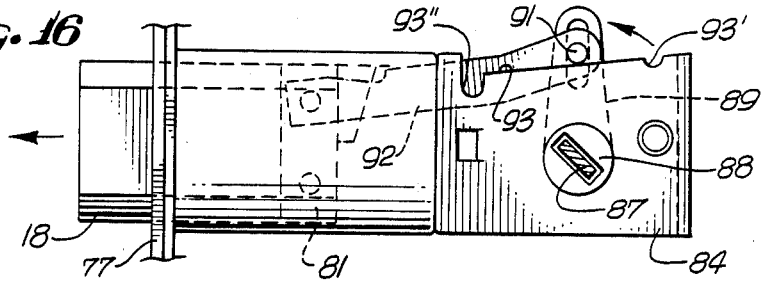
FIG. 16 is an enlarged fragmented vertical sectional view similar to FIG. 14 and illustrating movement of the deadbolt mechanism from a retracted position to an advanced position.
Figure 17:
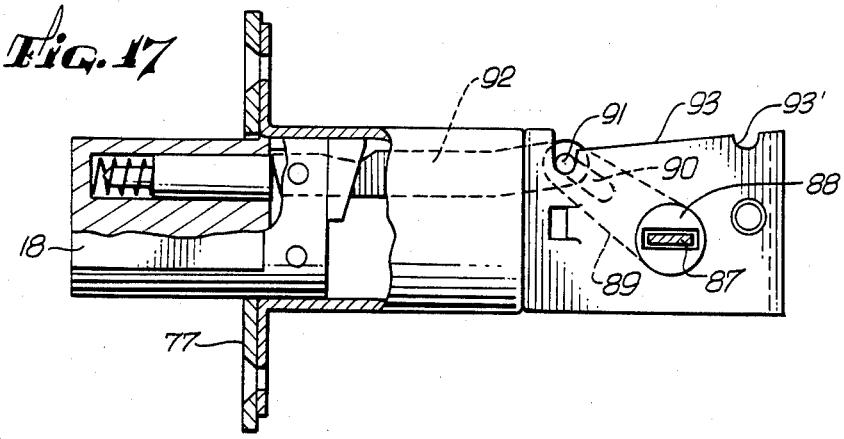
FIG. 17 is an enlarged fragmented vertical sectional view similar to FIG. 16 but illustrating the deadbolt mechanism in an advanced position.

As shown in FIGS. 10–12, the door handles 23 and 24 are supported from their respective escutcheons 27 and 28 by an improved mounting arrangement and in driving relation with the actuator shaft or shafts, with the single shaft 48 being depicted by way of example. This mounting arrangement is preferably the same for both handles, whereby the arrangement will be described further herein with resperct to the inner handle 23.

More specifically, as shown best in FIG. 12, the inboard side of each escutcheon includes a ring-shaped cavity 54 presented in the inboard direction and surrounding a central passage 55. A socket 56 of molded plastic or the like has a cylindrical exterior surface for pressing into the passage 55 from the outboard side and an outboard flange 57 for seating against the outer side of the escutcheon. The socket 56 further defines a square-drive recess 58 presented outwardly for seated reception of a square-drive head 59 on the inboard side of the handle 23. A screw 60 has its head seated on the inboard side of the socket 56 and its shank passed outwardly into the square-drive recess 58 for threaded reception into the square-drive head 59 of the handle (FIG. 10). A hollow retention lug 62 of square cross section is pressed into another square-drive recess 63 on the inboard side of the socket 56 to prevent the screw 60 from falling out prior to attachment to the handle 23.

Accordingly, the handle 23 is mounted quickly and easily to the socket 56 and thus also to the escutcheon 27 by means of the screw 60. This arrangement accommodates rapid removal and remounting of the handle as required for a left- or right-hand door mount. The actuator shaft 48 is then seated within the retention lug 62 to couple handle rotation to the cam sleeve 46, as described with respect to FIGS. 2–9.

The handle mounting arrangement further includes centering means to return the handle to an initial nonrotated position after each operation to retract the latch 14. This provision of center support means makes it possible to use lever-type handles, as shown in the drawings, of significant weight without handle droop or other movement from a desired, typically horizontal attitude when not in use.

As shown in FIGS. 10–12, this centering support means comprises a helical compression spring 65 or the like seated within the escutcheon ring cavity 54. The opposite ends of the spring 65 apply a spring force against an axially extending centering finger 66 formed on a centering washer 68 and also against an axially extending stop 69 within the ring cavity 54. This centering washer is retained against the spring 65 and substantially closes the inboard side of the ring cavity by means of a retainer ring 70 locked into a groove 56' in the socket 56. Diammetrically opposite lugs 71 on the centering washer are locked into drive slots 72 on the socket 56 whereby socket and handle rotation are transmitted to the centering washer 68. Accordingly, upon rotation of the lever handle 23, the centering washer finger 66 engages one end of the spring 65 to further compress the spring against the stop resulting in an increasing spring force for returning the handle when released to an initial nonrotated position. The relative positions of the stop 69 on the escutcheon together with the construction of the socket 56 and centering washer 68 are chosen to assure return of the handle to a predetermined position on the door.

The deadbolt mechanism 16 also comprises an improved device which is adapted to provide the requisite throw for the deadbolt 18 notwithstanding use of a relatively small cross bore. Moreover, the deadbolt mechanism 16 desirably includes the thumb turn 26 movable between locked and unlocked positions while visually representing the deadbolt position.

More particularly, as shown in FIGS. 13–19, the deadbolt mechanism 16 comprises a hollow cylindrical bolt case 75 sized to fit slidably into a bore 22' (FIG. 1) extending laterally from the adjacent cross bore 22 to the door marginal edge 20'. The bolt case 75 also includes an outer face shield 76 anchored to the door along with an overlying face plate 77 by means of screws 78 or the like. The deadbolt 18 is slidably received within the bolt case 75 and commonly uncludes an internal reinforcement pin 79 of hardened steel or the like. This reinforcement pin 79 is retained between a small compression spring 80 and a stop shield 81 secured to the rear end of the deadbolt 18 by roll pins 82 or the like.

The deadbolt is advanced or retracted within the bolt case 75 by a linkage positioned within a linkage housing 84. As shown best in FIGS. 13 and 18, this linkage housing is defined by a pair of housing halves with feet locked into the rear end of the bolt case and rear ends secured together by a rivet 86 or the like. An actuator blade 87 extends into this housing 84 through openings 84' to advance or retract the deadbolt by rotation of the drive sleeve 88 on the blade 87. This drive sleeve 88 carries an outwardly radiating drive yoke link 89 with a longitudinally elongated slot 90 within which is received a lost motion pin 91 at the rear end of an output link 92. The output link 92 in turn has its forward end pivotally coupled to the stop shield 81 at the rear end of the deadbolt 18.

In accordance with one aspect of the invention, the lost motion pin 91 rides along a ramped track 93 defined by the upper edges of the linkage housing halves, wherein this ramped track is nonhorizontal. More specifically, the drive yoke link 89 is movable between a bolt retracted position (FIG. 14) with the pin 91 in a track seat 93' to a bolt advanced position (FIG. 17) with the pin 91 in another track seat 93''. The track 93 angles downwardly between the two seats 93' and 93'' to accommodate a minimum bolt displacement of at least one inch while insuring the absence of interference with the inner diameter of the cross bore 22. This permits use of the deadbolt mechanism with relatively small cross bores.

Figure 18:
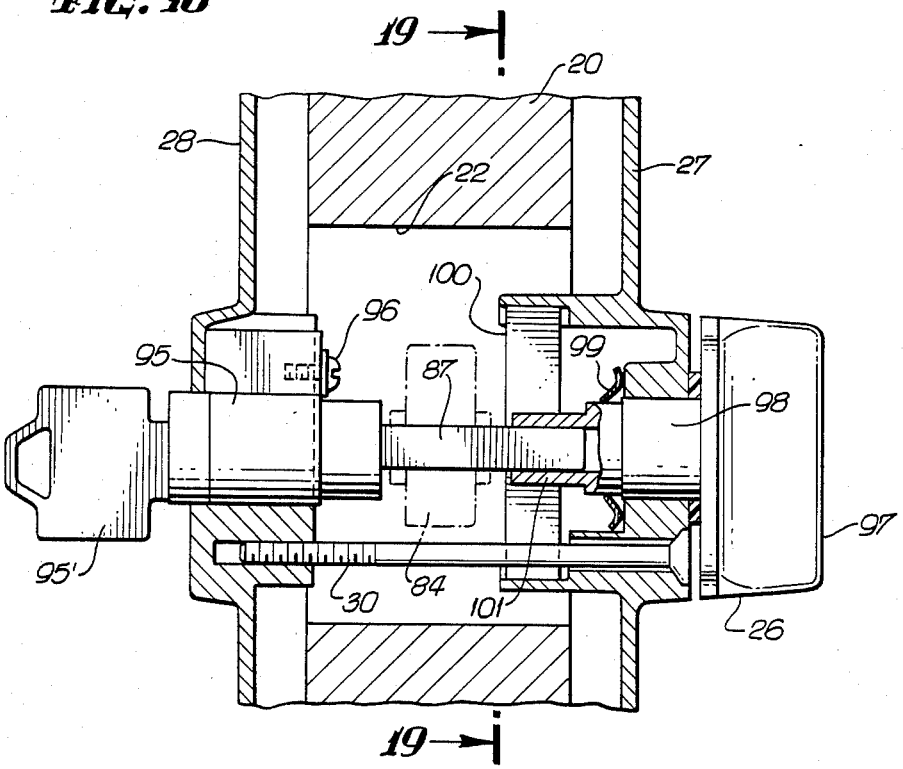
FIG. 18 is an enlarged fragmented vertical sectional view taken generally on the line 18—18 of FIG. 1.
Figure 19:
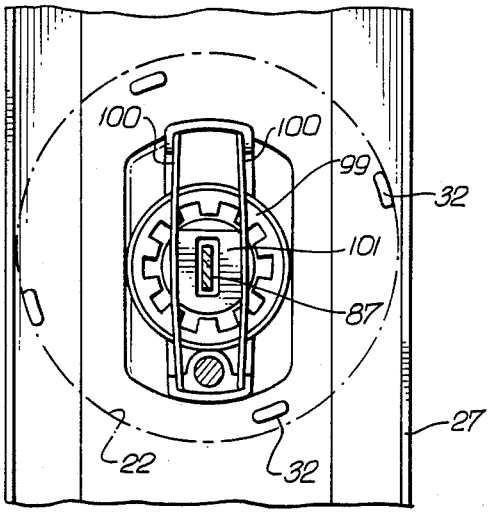
FIG. 19 is a fragmented vertical sectional view taken generally on the line 19—19 of FIG. 18.

As shown in FIGS. 18 and 19, the deadbolt actuator blade 87 extends between a key-operated lock unit 95 and the thumb turn 26. The key unit 95 is secured to the outer escutcheon 28 by a screw 96 or the like and is operated from the exterior of the door by a key 95' to rotate the actuator blade. Such actuator blade rotation shifts the position of the deadbolt to lock or unlock the door, as described above.

The thumb turn 26 includes an enlarged handle 97 with linear or straight appearance on the inside of the door. This handle is joined to a body portion 98 projecting through the escutcheon 27 and having a slotted inboard end receiving the actuator blade 87. A spring clip ring 99 is received over the body and bears against the inboard side of the escutcheon to hold the thumb turn in place.

The thumb turn 26 engages the actuator blade 87 in a predetermined rotational position to provide a visual indication of deadbolt position. That is, when the deadbolt is advanced, the thumb turn 26 is in a horizontal attitude on the door in parallel relation with the deadbolt. However, when the deadbolt is retracted, the thumb turn is in a vertical attitude on the door (FIGS. 2 and 18) to represent deadbolt retraction. A pair of leaf springs 100 (FIG. 19) are supported by the escutcheon to extend on opposite sides of a squared portion 101 of the thumb turn body to releasably retain the thumb turn in the vertical or horizontal position.

The improved door latch and deadbolt assembly of the present invention thus accommodates use with various different cross bore sizes. The latch mechanism has a simplified construction and can be provided in several different backset sizes, without requiring alteration of the remainder of the assembly. Moreover, the deadbolt mechanism is adapted to fit and operate within cross bores of different sizes, with the thumb turn visually representing deadbolt position. The deadbolt mechanism can also be provided in different sizes, if required, to fit different door backsets, in which case the deadbolt mechanism is quickly and easily installed without requiring any change to the remainder of the assembly.

A variety of further modifications and improvements are believed to be apparent to those of ordinary skill in the art. Accordingly, no limitation on the invention is intended by way of the description herein, except as set forth in the appended claims.

What is claimed is:

1. A combination door latch and deadbolt assembly, comprising:

an inner escutcheon and an outer escutcheon;

means for mounting said inner and outer escutcheons respectively on the inner and outer sides of a door in overlying relation with at least one cross bore formed in the door;

a latch mechanism carried by said inner and outer escutcheons and including a retractable latch and means accessibly operable from at least one side of the door for retracting said latch; and breakaway tabs on said inner and outer escutcheons, said tabs being oriented to fit snugly into a door cross bore of a first diametric size and adapted to be broken off to permit assembly mounting onto a door having a cross bore of a second smaller size.

2. The combination of claim 1 wherein said mounting means comprises at least one mounting screw fastened between said inner and outer escutcheons and extending through said at least one cross bore.

3. The combination of claim 1 further including a deadbolt mechanism carried by said inner and outer escutcheons.

4. The combination of claim 3 wherein the door has a pair of cross bores formed therein, said latch and deadbolt mechanisms being supported by said escutcheons respectively within said pair of cross bores.

5. The combination of claim 4 wherein said inner and outer escutcheons include said breakaway tabs to fit snugly within both of said pair of cross bores.

6. The combination of claim 3 wherein said deadbolt mechanism includes a deadbolt and means for advancing and retracting said deadbolt from at least the inner side of the door.

7. The combination of claim 6 wherein said deadbolt advancing and retracting means comprises a thumb turn movable between a first position generally parallel with said deadbolt when said deadbolt is in said advanced position and a second position generally perpendicular with said deadbolt when said deadbolt is in the retracted position, whereby said thumb turn visually represents deadbolt position.

8. The combination of claim 7 further including spring means for releasably retaining said thumb turn in said first and second positions.

9. The combination of claim 8 wherein said thumb turn includes a body portion of square cross section, said spring means comprising at least one leaf spring on said inner escutcheon in springable engagement with said thumb turn body portion.

10. The combination of claim 1 wherein said breakaway tabs comprise a plurality of said tabs at different diametric positions relative to said at least one cross bore whereby breaking off of some of said tabs at a first diametric position permits remaining ones of said tabs at a second smaller diametric position to fit snugly into said cross bore having a corresponding diametric size.

11. The combination of claim 1 wherein said latch retracting means comprises a pair of handles mounted respectively on the inner and outer sides of the door.

12. The combination of claim 11 further including a cam member rotatably displaced upon rotation of a selected one of said handles, a latch case supporting said latch and including spring means urging said latch normally toward an advanced position, and a latch retractor operably supported between said cam member and said latch for retracting said latch upon rotation of a selected one of said handles, said latch retractor having a one-piece construction extending in a first plane generally laterally between said cam member and said latch and including at least one twisted tab cam follower engaged by said cam member, said cam follower being bent from said first plane.

13. The combination of claim 12 wherein said retractor includes a pair of said twisted tab cam followers for respective engagement by said cam member upon rotation of one of said handles in opposite directions.

14. The combination of claim 3 wherein said deadbolt mechanism comprises a deadbolt case, a deadbolt slidable within said case, a rotatable sleeve within said at least one cross bore, means operable from at least the inner side of the door for rotating said sleeve, and a drive linkage coupled between said sleeve and said deadbolt for displacing said deadbolt between said advanced and retracted positions upon rotation of said cam sleeve, said drive linkage including a first link coupled to said sleeve, a second link coupled to said deadbolt, a lost motion connection between said first and second links and including a lost motion pin, and a ramped track for slidably guiding said lost motion pin along a path nonparallel to the direction of sliding deadbolt movement.

15. The combination of claim 14 wherein said drive linkage is supported by a housing within the cross bore, said ramped track being formed along said housing to extend angularly downwardly in a direction toward said deadbolt.

16. The combination of claim 11 wherein said handles each comprise a lever-type handle.

17. The combination of claim 16 further including means for rotatably supporting said handles in a predetermined initial rotational position relative to said inner and outer escutcheons.

18. The combination of claim 17 wherein said supporting means comprises a spring mounted on the inboard side of each of said escutcheons, and means coupled between said spring and the associated one of said handles for compressing said spring upon rotation of said one handle, whereby said spring returns said handle to its initial position when said handle is released.

19. The combination of claim 18 wherein said coupling means comprises a socket rotatably mounted within said escutcheon and having inboard and outboard square-drive recesses, said one handle having a square-drive head for reception into said outboard recess, fastener means receivable through said socket for connecting said socket to said one handle, a hollow square-drive lug receivable into said inboard square-drive recess to retain said fastener means therein, and means coupled between said lug and said latch for transferring rotational motion of said one handle through said socket to retract said latch, said socket further supporting a centering washer for rotation therewith, said washer having a finger engageable with said spring to compress same upon rotation of said one handle.

20. A combination door latch and deadbolt assembly, comprising:

an inner escutcheon and an outer escutcheon;

means for mounting said escutcheons respectively on the inner and outer sides of a door to overlie a pair of cross bores formed in the door;

a latch mechanism carried by said escutcheons within one of said cross bores and including a latch and means accessible from the inner and outer sides of the door for retracting said latch;

a deadbolt mechanism carried by said escutcheons within the other one of said cross bores and including a deadbolt and means accessible from the inner and outer sides of the door for advancing and retracting said deadbolt; and breakaway tabs on said escutcheons, said tabs being oriented to fit snugly into door cross bores of a first diametric size and adapted to be broken off to permit assembly mounting onto a door having cross bores of a second smaller diametric size.

21. The combination of claim 20 wherein said deadbolt advancing and retracting means comprises a thumb turn movable between a first position generally parallel with said deadbolt when said deadbolt is in said advanced position and a second position generally perpendicular with said deadbolt when said deadbolt is in said retracted position, whereby said thumb turn visually represents deadbolt position.

22. The combination of claim 20 wherein said breakaway tabs comprise a plurality of said tabs at different diametric positions relative to said cross bores whereby breaking off of some of said tabs at a first diametric position permits remaining ones of said tabs at a second smaller diametric position to fit snugly into said cross bores having a corresponding smaller diametric size.

* * * * *